US005463923A

United States Patent [19]

Kamijyo

[11] Patent Number: 5,463,923

[45] Date of Patent: Nov. 7, 1995

[54] ELECTRIC GUITAR HAVING A SOLID BODY MADE OF WOOD FIBER BOARD, AND METHOD OF MAKING THE SAME

[75] Inventor: Yoshimochi Kamijyo, Nagano, Japan

[73] Assignee: Fujigen Inc., Nagano, Japan

[21] Appl. No.: 137,740

[22] Filed: Oct. 19, 1993

[30] Foreign Application Priority Data

Jun. 4, 1993 [JP] Japan ..... 5-160337

[51] Int. Cl.[6] ..... G10D 3/00; G10D 1/08

[52] U.S. Cl. ..... 84/291; 84/293; 84/267; 84/452 R

[58] Field of Search ..... 84/291, 293, 267, 84/268, 269, 274, 275, 452 R; 156/219, 220, 240, 238, 283

[56] References Cited

U.S. PATENT DOCUMENTS

| | | | |
|---|---|---|---|
| 3,880,040 | 4/1975 | Kaman | 84/291 |
| 4,263,077 | 4/1981 | Rampelberg | 156/238 |
| 4,890,656 | 1/1990 | Ohsumi et al. | 156/283 |
| 5,010,803 | 4/1991 | Donnell | 84/291 |

*Primary Examiner*—Steven L. Stephan
*Assistant Examiner*—Cassandra Spyrou
*Attorney, Agent, or Firm*—Burns, Doane, Swecker & Mathis

[57] ABSTRACT

An electric guitar has a body part and a neck part made of medium-density fiberboard, with the density of about 0.5 g/cm$^3$, formed by heating and pressing wood fibers of single whitish conifer chips together with an adhesive, processed to be of a predetermined configuration. On each of the surfaces of the body part and the neck part, a printed layer with a grain pattern transferred from a sheet is formed. A medium-density fiberboard is inexpensive and has good processing characteristics. In addition, in the manufacturing process of the body part of the guitar, it requires no joining of plate materials or drying. Therefore, an electric guitar looking attractive can be produced at a low price.

8 Claims, 1 Drawing Sheet

ELECTRIC GUITAR HAVING A SOLID BODY MADE OF WOOD FIBER BOARD, AND METHOD OF MAKING THE SAME

BACKGROUND OF THE INVENTION

1. Field of the Invention

The present invention relates to an electric guitar. More particularly, the present invention pertains to a material constituting its body part and others.

2. Related Art

A conventional electric guitar has used southern wood and northern wood such as basswood, alder, ash and mahogany in its body part, and maple wood and others in its neck part. When an electric guitar is made of wood, however, because the width size of wood is limited, a body part is formed by joining narrow wood members in the width direction, therefore the design and treatment to hide and seal joints are necessary. In addition, since wood members shrink as they get dry, they require much labor in that wood members need to be dried for half a year to one year beforehand lest the tone and so on go out of tune after the assembly. Moreover, it is difficult to lower further the production cost of an electric guitar, since the material cost is high.

It is possible to produce an electric guitar of relatively inexpensive plywoods. If plywoods are used, however, since wood fibers get hairy on cut faces, it requires a long time to treat cut faces of the plywoods, and at the same time the sanding on the wood part is difficult. Therefore, even if plywoods are used in manufacturing a guitar, there remains a problem that an inexpensive guitar cannot be obtained and that the guitar produced looks poor.

Considering the above problems, an object of the present invention lies in providing an electric guitar looking attractive which needs no joining of plate materials or drying at a low price by using an inexpensive material having good processing characteristics.

SUMMARY

In order to solve the above-mentioned problems, in an electric guitar according to the present invention, a body part constituting its main body, and others, are composed of fiberboards formed by heating and pressing wood fibers together with an adhesive. It is preferred to make an electric guitar look much more attractive without raising the production cost by transferring a pattern to the surface of fiberboards employing vinyl chloride sheets or the like on which a grain pattern, a metallic pattern, and others are gravure printed.

In the present invention, it is preferred to use a medium density fiberboard with a density of about 0.5 g/cm$^3$, which is substantially equal to that of wood, as a fiberboard, in order to minimize the influence which the difference in the density has on the tone.

The fiberboards which constitute a body part and others of an electric guitar according to the present invention are inexpensive, because they are industrial products formed by heating and pressing wood fibers together with an adhesive. Furthermore, since fiberboards of a desired width size can be produced, there is no need to join plate materials in producing a body part. In addition, since fiberboards contain little moisture, the tone and others do not go out of tune after the assembly even if the fiberboards are not dried. Moreover, since fiberboards, unlike plywoods, have no hairiness of wood fibers on processed faces, and the sanding is easy to carry out, an electric guitar looking attractive can be produced at a low price.

PREFERRED EMBODIMENT OF THE INVENTION

Figure 1:
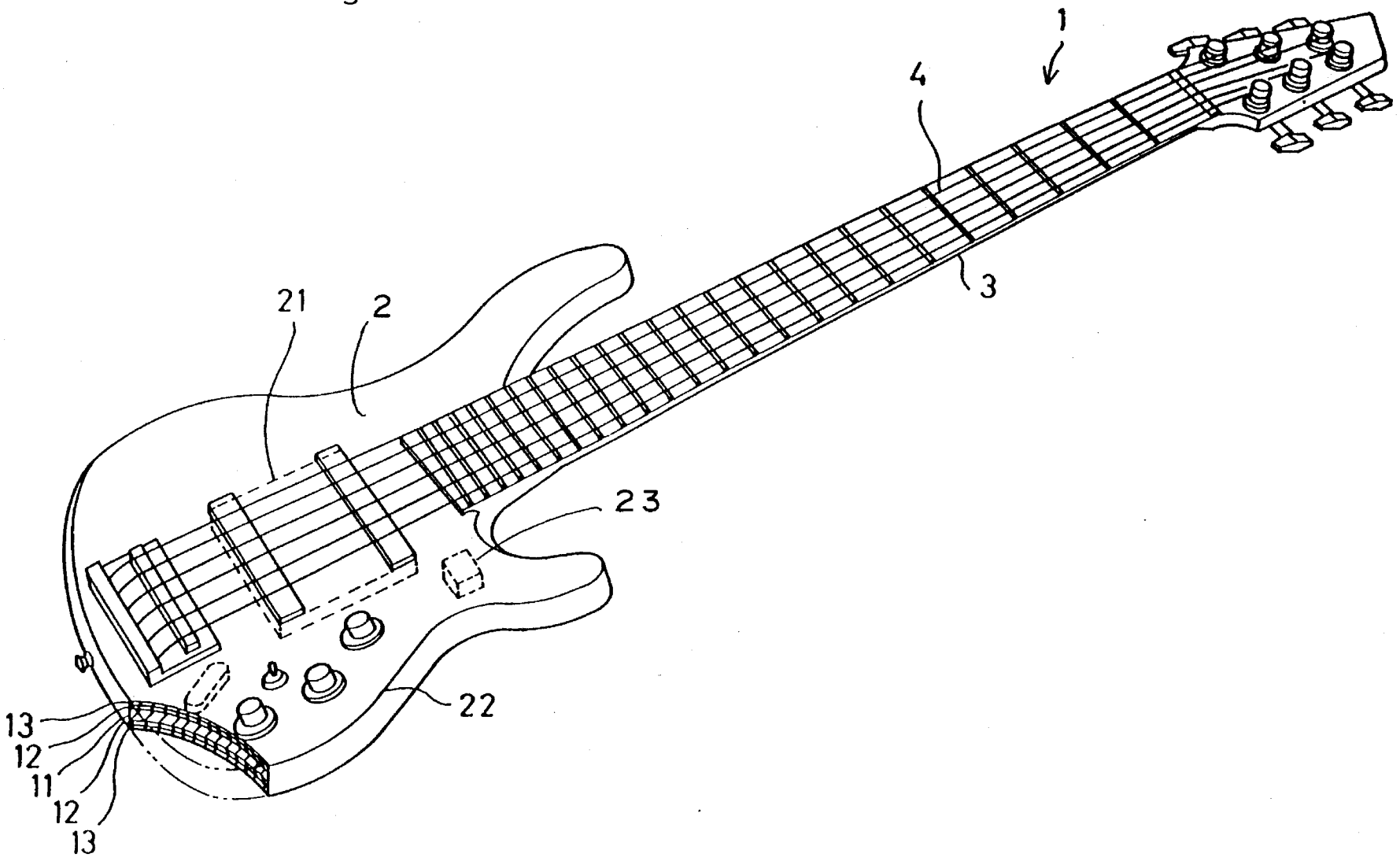
FIG. 1 is a perspective view showing diagrammatically an electric guitar according to an embodiment of the present invention, with a part of it cut out.

A embodiment according to the present invention will now be explained with reference to the attached drawing.

FIG. 1 is a perspective view showing diagrammatically a whole constitution of an electric guitar of this embodiment.

An electric guitar 1 has a body part 2, a neck part 3 set on an upper end of the body part 2, and six strings 4 stretched from a lower end side of the body part 2 to a tip side of the neck part 3. The surface of the body part 2, as is shown by dotted lines in FIG. 1, is hollowed out partially to a fixed depth, and an electric circuit which amplifies and outputs the vibration of strings 4 is put in the hollowed-out part 21. Similarly, on the back surface of the body part 2, a hollowed-out part 23 is formed in which an electric circuit is put. Note that the body part 2 is processed in such a way that a brim part 22 thereof is made to be a curved surface. The back surface side of the neck part 3 is also made to be a curved surface.

The body part 2 of the electric guitar 1 of this embodiment, as is shown by the section of the guitar partially cut out, is made of medium-density fiberboard 11. This fiberboard is formed by heating and pressing wood fibers of single whitish conifer chips together with such an adhesive as ureas, with the density of about 0.5 g/cm$^3$ and the thickness of 42 to 45 mm, processed to be of a fixed configuration. On the surface of the fiberboard 11, a mirror coating is performed. The neck part 3 is also made of the above-mentioned medium-density fiberboard, processed to be of a fixed configuration, on the surface of which a mirror surface coating is performed.

A printed layer 12 of a grain pattern, transferred from a thin vinyl chloride sheet on which a grain pattern is gravure printed, is formed on the surfaces of the body and neck parts made of medium-density fiberboard. Further, on the surface of the printed layer 12, a transparent coating layer 13 is mirror coated. Therefore the electric guitar 1 of this embodiment looks more attractive than the conventional one made of wood.

In a manufacturing method of the electric guitar 1 constituted above, in a manufacturing process of the body part 2, a blank of medium-density fiberboard, with a sufficient width size to produce the body, is processed to be of a fixed configuration conforming to that of the body part 2. Conventionally, the surface of the resultant body part needs to be sanded afterwards. In this embodiment, however, the sanding is unnecessary because the front and back surfaces of the body part are smooth. Then, after the hollowed-out part 21 is formed in the body part of medium-density fiberboard, a grain pattern printed on a vinyl chloride sheet is transferred to the surface of the body part to form the printed layer 12 with a grain pattern. Thereafter, a mirror coating is performed on the surface of the printed layer 12 by the coating layer 13.

The neck part 3, on the other hand, independently of the body part 2, is processed and sanded after a blank of medium-density fiberboard is cut to be of a fixed configuration conforming to that of the neck part. Then, the printed layer 12 with a grain pattern is formed on the resultant neck part by transferring a pattern from a vinyl chloride sheet. After a mirror coating is performed on the neck part by the coating layer 13, the obtained neck part 3 is set on the body part 2.

Note that a medium-density fiberboard has no hairiness of wood fibers and the like on cut faces, unlike plywoods, because wood fibers are hardened by an adhesive and cut faces formed thereon are dense. Accordingly, such processes as those in which the hollowed-out part 21 is formed in the body part 2, and the brim part 22 of the body part 2 and the back side of the neck part 3 are made to be curved surfaces, can be performed easily in a short time, and can achieve an excellent finish. Furthermore, the mirror coating of the body part 2 and the neck part 3 can be done easily in a short time, and can achieve an excellent finish.

A medium-density fiberboard is homogeneous in any direction because wood fibers are dispersed in each direction. Therefore, a medium-density fiberboard does not warp because of a grain direction, knots, and the like in addition, since a medium-density fiberboard contains little moisture, a delivered fiberboard can be processed at once to be the body part 2 and the neck part 3 without performing a drying process. Moreover, since a medium-density fiberboard has a relatively low hygroscopic length expansivity of about 1.6% and a relatively low hygroscopic thickness expansivity of about 6.6%, the body part 2 and the neck part 3 are not transformed when they absorb moisture. Hence the simplification of a manufacturing process and the stabilization of the quality of the electric guitar 1 can be obtained.

Furthermore, a medium-density fiberboard is inexpensive because it can be mass-produced industrially. In addition, a medium-density fiberboard is preferable from the viewpoint of environmental protection because it can use material woods with high yield rate and therefore can make effective use of wood resources.

The electric guitar 1 of this embodiment has a grain pattern transferred to the surfaces of the body and neck parts made of medium-density fiberboard, therefore the guitar has a more attractive appearance than a conventional wood guitar, and is inexpensive.

Since a medium-density fiberboard of a sufficient width size to produce the body part 2 can be easily produced, it is not necessary to join narrow boards as is in the conventional wood guitar. As there is no joint in the body part 2, the electric guitar 1 looks attractive even when the surface of the electric guitar 1 is finished without transferring a pattern to the surface of the body part 2 and others made of medium-density fiberboard. Note that a medium-density fiberboard, unlike woods or plywoods, can be coated easily and has an excellent finish.

A medium-density fiberboard has the density of about 0.55 g/cm$^3$, substantially equal to that of wood (0.5 g/cm$^3$). Accordingly, if medium-density fiberboard is employed instead of wood to make an electric guitar, the acoustic properties equal to those of wood guitars can be obtained because the difference in the density and the like do not have much influence on the tone. Furthermore, since a medium-density fiberboard is an industrial product to which various materials can be added in its manufacturing process, it is possible to adjust the physical properties of a medium-density fiberboard to the optimum value to improve the acoustic properties of the electric guitar 1 by changing the composition of the fiberboard.

Note that the configuration of the body part 2 and the neck part 3, and the size and number of the hollowed-out part 21 formed in the body part 2 are not limited to those of the above-mentioned embodiment. On the contrary, they should be determined to be optimum according to the kind of an electric guitar and the tone sought for.

As was explained above, the body part and others of the electric guitar according to the present invention are characterized by being made of processed fiberboards formed by heating and pressing wood fibers together with an adhesive. Hence, according to the present invention, since fiberboards used in the electric guitar are industrial products and wide ones can be produced at a low cost, the material cost is low, and moreover, they can constitute the body part without being joined in the width direction, so there is no joint on the surface. Accordingly, no design or process is required to hide or seal joints. Furthermore, a fiberboard has a high strength and because the strength and processing characteristics are homogeneous, it seldom warps. And since there is no hairiness of wood fibers on processed faces, a fiberboard can be processed easily. In addition, it can be produced easily because it needs no long drying. Therefore, an electric guitar of good quality looking attractive can be produced at a low price. Furthermore, since a fiberboard is an industrial product to which various materials can be added in its manufacturing process, it is possible to adjust the physical properties of a fiberboard to the optimum conditions to improve the acoustic properties of an electric guitar by changing the composition of the fiberboard.

And when a grain pattern and the like are transferred from a sheet to a fiberboard, an electric guitar looking more attractive than a conventional wood electric guitar can be produced at a low price.

Furthermore, when a medium-density fiberboard with the density of about 0.5 g/cm$^3$ is employed as a fiberboard, since its density is substantially equal to that of wood, the influence of the difference in the density on the tone can be minimized.

I claim:

1. An electric guitar, comprising:

a main body part; and a neck part;

said main body part is substantially solid; and said neck part and said main body part are comprised of fiberboard made from wood fibers and an adhesive.

2. The electric guitar of claim 1, wherein said fiberboard is a medium density fiberboard of about 0.55 g/cm$^3$.

3. The electric guitar of claim 1, wherein a surface of said fiberboard includes a pattern transferred thereon and a transparent coating layer on said pattern.

4. A method of making an electric guitar, comprising the steps of:

forming a fiberboard by heating and pressing wood chips together with an adhesive;

processing the fiberboard to a shape of a body part for the electric guitar;

transferring a pattern to the fiberboard;

coating the pattern with a transparent layer; and setting a neck part on the body part.

5. The method of claim 4, further comprising the step of processing the neck part from a fiberboard.

6. The method of claim 4, wherein the forming step forms the fiberboard with a density of about 0.55 g/cm$^3$.

7. The method of claim 4, wherein the forming step uses urea as the adhesive.

8. The method of claim 4, wherein the processing step forms the body part with a thickness of 42 to 45 mm.

* * * * *